US008574024B2

(12) United States Patent
Amireh

(10) Patent No.: US 8,574,024 B2
(45) Date of Patent: Nov. 5, 2013

(54) REMOTELY CONTROLLABLE TOY AND WIRELESS REMOTE CONTROL UNIT COMBINATION

(75) Inventor: Nicholas Amireh, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 238 days.

(21) Appl. No.: 13/241,606

(22) Filed: Sep. 23, 2011

(65) Prior Publication Data

US 2012/0077411 A1 Mar. 29, 2012

Related U.S. Application Data

(60) Provisional application No. 61/387,495, filed on Sep. 29, 2010.

(51) Int. Cl.
*A63H 30/04* (2006.01)

(52) U.S. Cl.
USPC ..... 446/456; 446/454

(58) Field of Classification Search
USPC ..... 446/454, 456
See application file for complete search history.

(56) References Cited

U.S. PATENT DOCUMENTS

| | | | | |
|---|---|---|---|---|
| 3,402,505 | A | | 9/1968 | Nakamura |
| 3,720,281 | A | | 3/1973 | Frownfelter |
| 4,112,615 | A | | 9/1978 | Ishimoto |
| 4,349,986 | A | | 9/1982 | Tsukuda |
| 4,400,698 | A | | 8/1983 | Wessels et al. |
| 4,508,516 | A | | 4/1985 | D'Andrade et al. |
| 4,563,162 | A | | 1/1986 | Ishimoto |
| 4,565,538 | A | | 1/1986 | Kennedy et al. |
| 4,573,943 | A | | 3/1986 | Kennedy et al. |
| 4,577,528 | A | | 3/1986 | Hanzawa |
| 4,655,724 | A | | 4/1987 | Law |
| 4,795,395 | A | | 1/1989 | Oishi et al. |
| 4,891,029 | A | | 1/1990 | Hutchinson |
| 4,964,837 | A | | 10/1990 | Collier |
| 5,065,078 | A | | 11/1991 | Nao et al. |
| 5,195,920 | A | | 3/1993 | Collier |
| 5,273,480 | A | | 12/1993 | Suto |
| 5,304,088 | A | | 4/1994 | Suimon |
| 5,320,574 | A | | 6/1994 | Lahr et al. |
| 5,334,075 | A | | 8/1994 | Kakizaki et al. |
| 5,401,201 | A | | 3/1995 | Muraki |
| 5,429,543 | A | | 7/1995 | Tilbor et al. |
| 5,481,257 | A | * | 1/1996 | Brubaker et al. ..... 340/12.55 |
| 5,580,296 | A | | 12/1996 | Chow |

(Continued)

FOREIGN PATENT DOCUMENTS

| | | | |
|---|---|---|---|
| GB | 2194458 | A | 3/1988 |
| GB | 2252281 | A | 8/1992 |

*Primary Examiner* — Michael Dennis
(74) *Attorney, Agent, or Firm* — Panitch Schwarze Belisario & Nadel LLP

(57) ABSTRACT

A hand held remote control unit includes a wireless signal transmitter configured to transmit a fixed frequency (tone) signal and a manually operated switch to selectively operate the transmitter to transmit the wireless tone signal. A toy has an appropriate wireless signal receiver and control circuit responsive to the tone signal that controls one or more electrically operated devices that can provide at least two different, electrically activated responses of the toy apparent to an observer. The control circuit provides a sequence of two or more different predetermined responses of the toy in response to sequential reception and loss of the tone signal, the sequence of responses being repeated after completion.

9 Claims, 3 Drawing Sheets

(56) References Cited

U.S. PATENT DOCUMENTS

| | | | | |
|---|---|---|---|---|
| 5,643,041 | A | 7/1997 | Mukaida | |
| 5,727,985 | A | 3/1998 | George et al. | |
| 5,741,185 | A * | 4/1998 | Kwan et al. | 463/51 |
| 5,803,790 | A | 9/1998 | Tilbor et al. | |
| 5,871,386 | A | 2/1999 | Bart et al. | |
| 5,919,075 | A | 7/1999 | George et al. | |
| 6,066,026 | A | 5/2000 | Bart et al. | |
| 6,123,600 | A | 9/2000 | Yuen | |
| 6,238,265 | B1 | 5/2001 | Crane et al. | |
| 6,386,058 | B1 | 5/2002 | Lu et al. | |
| 6,394,877 | B1 | 5/2002 | Venditti | |
| 6,439,948 | B1 | 8/2002 | Ostendorff et al. | |
| 6,475,059 | B1 | 11/2002 | Lee | |
| 6,482,069 | B1 | 11/2002 | Tilbor et al. | |
| 6,551,169 | B2 | 4/2003 | Jaffe | |
| 6,589,098 | B2 | 7/2003 | Lee et al. | |
| 6,656,012 | B1 | 12/2003 | DeAngelis et al. | |
| 6,663,463 | B1 * | 12/2003 | Dougherty et al. | 446/409 |
| 6,666,746 | B2 * | 12/2003 | Aldred et al. | 446/454 |
| 6,682,394 | B2 | 1/2004 | Tilbor et al. | |
| 6,752,684 | B1 | 6/2004 | Lee | |
| 6,780,077 | B2 * | 8/2004 | Baumgartner et al. | 446/175 |
| 6,964,572 | B2 * | 11/2005 | Cesa | 434/258 |
| 7,018,265 | B2 | 3/2006 | Ghaly | |
| 7,217,170 | B2 | 5/2007 | Moll et al. | |
| 7,234,990 | B2 | 6/2007 | Leonov et al. | |
| 7,491,111 | B2 | 2/2009 | Ghaly | |
| 7,553,212 | B2 | 6/2009 | Yamaguchi | |
| 2003/0220047 | A1 | 11/2003 | Aldred et al. | |
| 2009/0264046 | A1 | 10/2009 | Mayer | |

* cited by examiner

REMOTELY CONTROLLABLE TOY AND WIRELESS REMOTE CONTROL UNIT COMBINATION

CROSS-REFERENCE TO RELATED APPLICATIONS

This Application claims benefit of priority from U.S. Patent Application No. 61/387,495 filed Sep. 29, 2010.

BACKGROUND OF THE INVENTION

Various types of remotely controlled toy and wireless remote control unit combinations are known. Those in the remote control toy art are constantly challenged to devise the new toys and new ways of remotely operating those toys. The challenge at the high end is to provide the greatest number of separately remotely controlled capabilities and the finest level of operational control to most closely mimic the operation of a real thing (living or mechanical). The challenge at the low end is to minimize production costs while providing the most remotely controlled operating capabilities of the toy. Another challenge at the low end is to simplify control of a toy to enable younger children, in some cases even toddlers, to operate such toys themselves for their own amusement.

In the remote control toy vehicle art, one common solution to the challenges at the low end was to provide a motorized toy vehicle with a tone signal generating wireless remote control. Whenever the tone signal was generated by user depression of a button or other manual input device, the vehicle receiving the tone signal would move forward for as long as the tone signal was received. If one or more other, different responses was desired of the toy vehicle, like reverse operation or steering, the transmitter was configured to generate and the toy vehicle configured to decode a different control signal for each different operation Thus, for forward and reverse operation, two separate control signals had to be generated and decoded. If steering was added to forward and reverse operation, four separate control signals were required.

One innovation to provide propulsion and steering capability in a low end toy vehicle provided with a single reversible electric motor was "J steering" or "J turning". A single output drive from the motor was fed to wheels on opposite sides of the vehicle through separate drive shafts. One drive shaft/wheel combination was connected directly with the motor drive. The other was connected through a "slide" or planetary gear and an idler gear. When the motor was driven in a first, forward propelling direction, both wheels were driven in the same rotational direction on a common axis between the two wheels. When the motor was driven in an opposite direction, the direction of the first wheel was reversed but the slide or planetary gear was pushed out of engagement with the second wheel's axle and into engagement with the idler gear which was itself engaged with the second wheel's axle. The idler gear reversed the rotation between the planetary gear and the second wheel's axle, which caused the second wheel's axle to continue to rotate in the first (i.e. forward propelling) direction. Thus, the driven wheels were now driven in opposite directions causing the vehicle to turn while backing up. By controlling ratios of the various gears including the idler, the two powered wheels can be made to rotate at different RPMs and the vehicle made to follow a circular path while backing up. The vehicle could be driven forward in a relatively straight line. If it needed to turn, it would have to reverse itself along the circular path until pointing in the desired direction, at which point it could be commanded to drive forward again. While this simplified the design of the vehicle, two separate command signals for forward and reverse movement still had to be generated by the remote controller and decoded by the vehicle.

One recent combination intended to simplify the provision of forward and reverse operation in a low end, remotely controlled toy vehicle has been to provide the toy vehicle with an on-off switch, a wireless signal receiver and control circuitry. The control circuitry was configured to supply power to an electric motor propelling the toy vehicle in a first direction, preferably a reverse J turn, for as long as the on-off switch was on. The direction of power supplied to the motor was switch when a fixed frequency or "tone" control signal was received from the remote control unit, causing the vehicle to move forward in a straight line. This simplified the design of both the transmission/reception circuits as only a single tone signal needed to be generated and identified to control forward and reverse movement.

It was thought this simplified system might be improved in other ways.

BRIEF SUMMARY OF THE INVENTION

In one aspect, the invention is a toy combination comprising: a wireless remote control unit including a housing small enough to be held by a child with at least: an electric power supply; a wireless signal transmitter configured to generate and transmit a continuous tone signal of a fixed frequency when powered by the power supply; and at least one manually operated switch having at least two states respectively operatively connecting and disconnecting the power supply with the wireless transmitter to selectively transmit the continuous tone signal of the fixed frequency; and a toy vehicle with at least: an on-board power supply; a wireless signal receiver responsive to the continuous tone signal of the fixed frequency transmitted from the remote control unit; a control circuit responsive to the wireless signal receiver and operatively connected with the on-board power supply for controlling at least two different, electrically activated responses apparent to an observer, the control circuit being configured to provide a first activation of only a first one of the two different, electrically activated responses in response to reception by the receiver of a first occurrence of continuous tone signal of the fixed frequency from the wireless signal transmitter, to continue the first activation for as long as the first occurrence of the continuous tone signal of the fixed frequency is received by the receiver, to discontinue the first activation in response to a loss of reception of the first occurrence of the continuous tone signal of the fixed frequency by the receiver, and to provide a second activation of only a second one of the two different, electrically activated responses different from the first one in response to reception by the receiver of a second occurrence of the continuous tone signal of the fixed frequency from the remote control unit transmitter; and to thereafter discontinue the second activation in response to loss of reception of the second occurrence of the continuous tone signal of the fixed frequency.

In another aspect, the invention is a toy combination comprising: a wireless remote control unit including a housing sufficiently small to be hand held and at least: an electric power supply; a wireless signal transmitter configured to generate and transmit a continuous tone signal of a fixed frequency when powered by the power supply; and at least one manually operated switch having at least two states respectively operatively connecting and disconnecting the power supply with the wireless transmitter to selectively transmit the continuous tone signal of the fixed frequency. The combination further comprises a toy with at least: an on-board power supply; one or more electrically operated device each providing at least one of light, sound and movement of the toy apparent to an observer; a wireless signal receiver to receive the continuous tone signal of the fixed frequency; and a control circuit operably connected with the wireless signal receiver, the on-board power supply and each of the one or more electrically operated devices and responsive to the tone signal to control the at least one or more electrically operated devices to provide a predetermined sequence of separate and different activations apparent to an observer of the one or more devices in response to consecutive receptions and losses of reception of the continuous tone signal, each different response beginning with a new reception of the continuous tone signal and ending with loss of the reception of the continuous tone signal, the next activation of the sequence beginning with the next reception of the continuous tone signal, the sequence being continued and repeated for as long as reception and subsequent loss of reception of the continuous tone signal occurs.

In another aspect, the invention is a method of operating the aforesaid combination comprising the following steps in order: manually operating the switch of the wireless remote control unit to broadcast through the wireless signal transmitter of the unit, a first occurrence of the continuous tone signal of the fixed frequency; receiving the first occurrence of the continuous tone signal at the toy vehicle via the receiver; providing a first activation of only the first one of the two different, electrically activated responses in response to reception by the receiver of the first occurrence of continuous tone signal of the fixed frequency from the wireless signal transmitter and continuing the first activation for as long as the first occurrence of the continuous tone signal of the fixed frequency is received by the receiver; releasing the switch of the wireless remote control unit to discontinue the broadcast of the first occurrence of the continuous tone signal of the fixed frequency; discontinuing the first activation in response to a loss of reception of the first occurrence of the continuous tone signal of the fixed frequency by the receiver; manually operating the switch of the wireless remote control unit a second consecutive time to broadcast through the wireless signal transmitter of the unit, a second occurrence of the continuous tone signal of the fixed frequency; providing a second activation of only the second one of the two different, electrically activated responses different from the first one in response to reception by the receiver of the second occurrence of the continuous tone signal of the fixed frequency from the remote control unit transmitter; releasing the switch of the wireless remote control unit to discontinue the broadcast of the second occurrence of the continuous tone signal of the fixed frequency; and discontinuing the second activation in response to loss of reception of the second occurrence of the continuous tone signal of the fixed frequency.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

In the various figures, like numerals will be used to indicate like elements.

Figure 1:
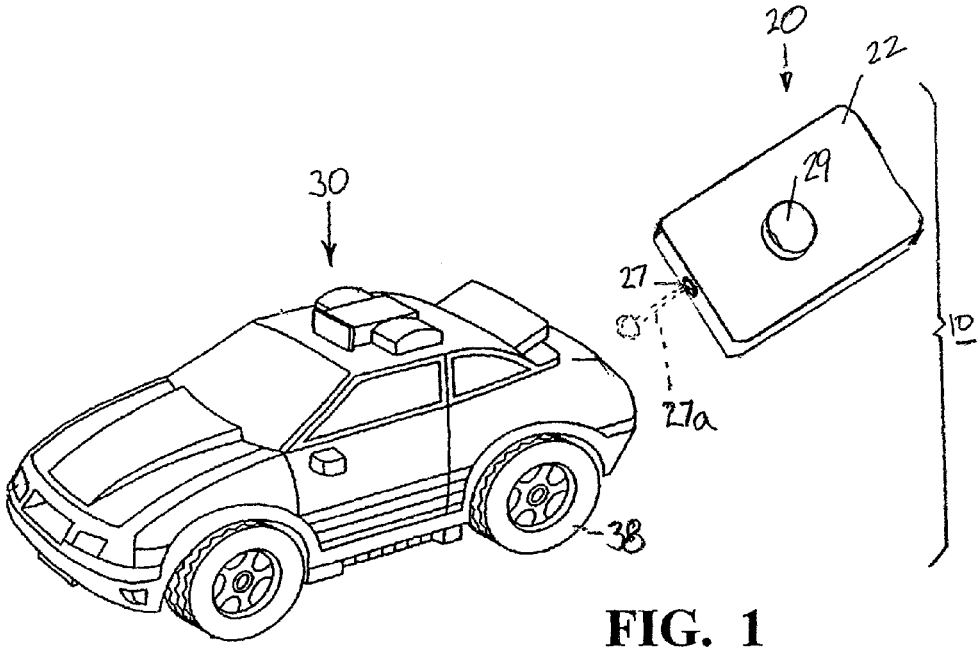
FIG. 1 depicts a remotely controlled toy vehicle and wireless remote control unit used to control the toy vehicle.
Figure 2:
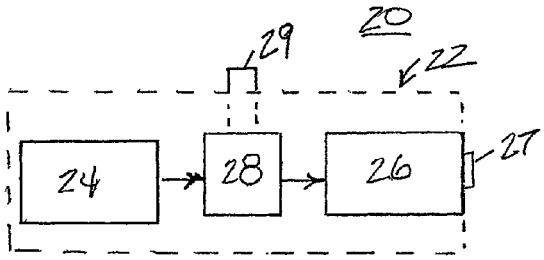
FIG. 2 is a block diagram of the circuit of the remote control unit.

FIG. 1 depicts a combination 10 of the invention provided by a wireless remote control unit or transmitter unit or "TX" 20 and a toy 30 remotely controlled in at least some respect(s) by the TX 20. Referring also to FIG. 2, which depicts typical circuitry for a TX 20 in block diagram form, TX 20 includes a housing 22 sufficiently small to be hand held preferably by a small child or even a toddler, with at least an electric power supply 24 preferably including one or more batteries within the housing 22, a wireless signal transmitter 26 configured to generate and transmit a continuous tone signal of a fixed frequency when powered by the power supply 24 and at least one manually operated switch 28 having at least two states respectively connecting and disconnecting the power supply 22 with the wireless signal transmitter 26 to selectively transmit the continuous tone signal of the fixed frequency.

The at least one manually operated switch 28 is preferably any type of manually operated, momentary contact switch that is biased open when not being closed by a user. It may have an actuator button 29 or other manually depressed member. The wireless signal transmitter 26 may take different forms but each form includes a transducer or broadcast element 27. If control via light is desired, the transmitter 26 may include an infrared or other type of LED that will broadcast a wireless, light signal of fixed predetermined wavelength and thus fixed frequency (i.e. a "tone" signal) when powered at a suitable voltage by the power supply 24 through appropriate buffer circuitry (none depicted). If a radio wireless signal transmitter is desired, it will include a fixed radio frequency generator, such as an electronic RF oscillator which, when powered at a suitable voltage by the power supply 24 through appropriate buffer circuitry, will output a fixed frequency radio signal (i.e. a tone carrier signal) through a suitable amplifier to an antenna (e.g. broadcast element 27*a*, in phantom in FIG. 1). If the wireless signal is sound, a suitably selected piezoelectric crystal speaker may be the broadcast element 27 and driven powered by an appropriately selected oscillator and buffer circuitry (neither depicted) to generate an audio or ultrasonic fixed frequency (i.e. tone) signal.

Figure 3:
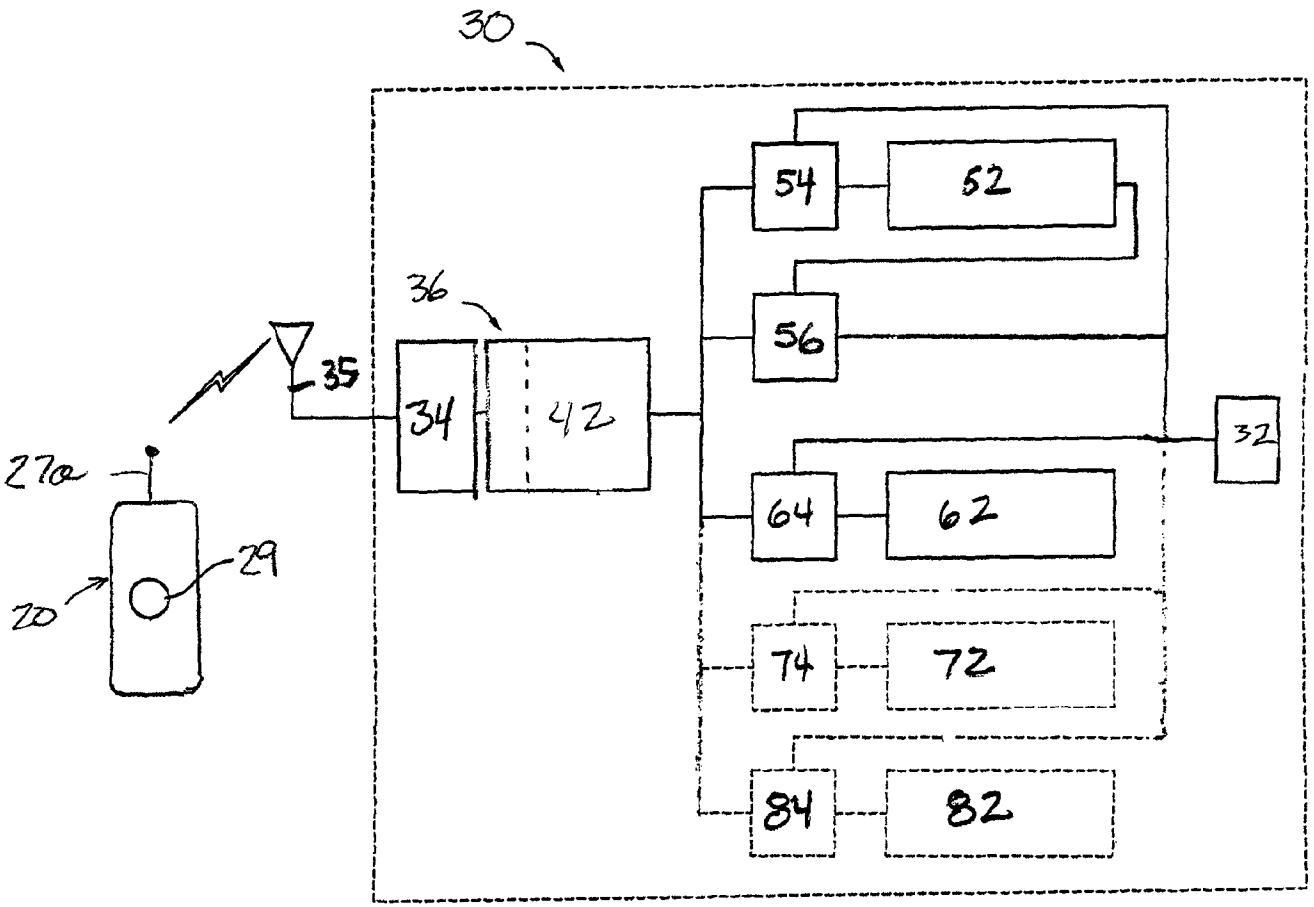
FIG. 3 is a block diagram of the circuit of the toy vehicle.

The remotely controlled toy is preferably a toy vehicle 30. According to an important aspect of the invention, the toy has at least two different, electrically activated responses apparent to an observer, as will be explained. But first, FIG. 3 is a block diagram of the electrical components of a remotely controlled toy 30 of the present invention. These electrical components include an on-board power electric supply 32, a wireless signal receiver 34 appropriate for the continuous tone signal transmitted from the remote control unit 20 and a control circuit 36 operably connected with the wireless signal receiver 34 and responsive to wireless tone signal. The toy 30 further includes as the receiver 34 or operably connected with a receiver circuit, a transducer 35 receptive to the continuous fixed frequency (tone) signal, for example a photodiode to a light signal, an antenna for a radio signal or a microphone for a sound signal. The control circuit 36 is also operatively connected with the on-board power supply 32 and configured for controlling the at least two different, electrically activated responses apparent to an observer. Preferably the control circuit includes a preprogrammed microprocessor 42. In this embodiment, the control circuit 36 is further preferably provided with reversing motor control subcircuits 54, 56 coupled by the microprocessor 42 with the power supply 32 to provide power to a reversible electric motor 52.

More specifically, the remotely controlled toy includes one or more electrically operated devices that can provide at least two different, electrically activated responses of the toy apparent to an observer. Control circuit 36 is configured to provide a first activation of only a first one of the two different, electrically activated responses in response to reception by the receiver 34 of a first occurrence of the continuous tone signal of the fixed frequency from the wireless signal transmitter 26; to continue the first activation for as long as the first occurrence of the continuous tone signal of the fixed frequency is received by the receiver 34; to discontinue the first activation in response to a loss of reception of the first occurrence of the continuous tone signal of the fixed frequency by the receiver 34; to provide a second activation of only a second one of the two different, electrically activated responses different from the first one in response to reception by the receiver 34 of a second occurrence of the continuous tone signal of the fixed frequency from the remote control unit transmitter 26; and to thereafter discontinue the second activation in response to loss of reception of the second occurrence of the continuous tone signal of the fixed frequency. The process can be expanded to a third or more different, electrically activated, predetermined responses provided in sequence by the control circuit in response to sequential receptions and losses of the tone signal, the sequence of responses being repeated after a completion of the sequence.

Preferably, the toy vehicle 30 comprises an electric motor 52 that provides at least one of the at least two different, electrically activated responses, namely forward propulsion of the toy vehicle 30. To that end, the control circuit 36 is operatively connected with the electric motor 52 so as to provide a first activation of the electric motor 52 in response to reception by the receiver 34 of a first occurrence of the continuous tone signal of the fixed frequency from the wireless signal transmitter 26 as the first activation of the toy vehicle 30.

In this preferred embodiment toy vehicle 30, the control circuit 36 is preferably operatively connected with the electric motor 52 so as to provide a second activation of the electric motor 52 in a reverse direction to the first actuation as the second activation of the toy vehicle 30 in response to reception by the receiver 34 of a second occurrence of the continuous tone signal of the fixed frequency from the wireless signal transmitter 26 consecutively after the reception and loss of reception of the first occurrence of the continuous tone signal by the receiver 34. Microprocessor 42 sequentially activates each motor control 54, 56 to provide power to the motor 52 successively in opposing directions to switch the direction of rotation of the motor 52 and propel the toy vehicle successively in forward and reverse directions. The toy vehicle 30 might be configured so that at least one or more wheels 38 at one end of the toy vehicle 30 are driven together in forward propulsion or reverse propulsion direction so that the toy vehicle 30 moves forward and back without turning. More preferably, the toy vehicle 30 is equipped with a drive train providing J steering or J turning as described above.

Instead of or in addition to the two motor control subcircuits 54, 56, the control circuit 36 could be operatively connected through another subcircuit 64 with yet another electrically activated device 62 generating at least one of light, sound and movement of at least part of the toy vehicle 30 and configured so as to operate the other electrically activated device 62 as the second activation in response to reception by the receiver 34 of the second occurrence of the continuous tone signal of the fixed frequency from the wireless signal transmitter 26, consecutively after the reception and loss of reception of the first occurrence of the continuous tone signal of the fixed frequency from the wireless signal transmitter 26. Thus, the control circuit 36 could be provided only with subcircuits 54 and 56 or 54 and 64 or 54, 56 and 64 or any combination of those three with additional subcircuits 74, 84, etc. and corresponding, separately electrically actuated devices 72, 82, etc. The devices 62, 72, 82, etc., may be any electrically activated device normally found in a toy such as a light or light display, a speaker of some form, another motor or other movement generator such as an pump, electromagnet, coil, piezoelectric transducer, etc.

Where another subcircuit 64 and another electrically activated device 62 generating at least one of light, sound and movement of part of the toy vehicle is provided with just a first motor control subcircuit 54, the control circuit 36 is operatively connected with the other electrically responsive device 62 through the other subcircuit 64 and configured so as to operate the other electrically responsive device 62 as the second activation in response to reception by the receiver 34 of the second occurrence of the continuous tone signal from the wireless signal transmitter 26 consecutively after the reception and loss of reception of the first occurrence of the continuous tone signal.

Where subcircuit 64 and another electrically activated device 62 is provided with the first and second motor control subcircuits 54, 56, the control circuit 36 is preferably further configured to provide a third activation, this time of the other electrically actuated device 62 through the third subcircuit 64, to provide a third electrically activated response different from the first and second electrically activated responses (i.e. the forward and reverse movement of the vehicle 30) in response to reception by the receiver 34 of a third consecutive occurrence of the continuous tone signal from the wireless signal transmitter 26 consecutively after reception and loss of reception of the first and second occurrences of the continuous tone signal. The control circuit 36 is preferably further configured to continue the third activation of third electrically activated response without activation of the first or second electrically activated responses (i.e. without activation of the electric motor 52 in any rotational direction) for as long as the third occurrence of the continuous tone signal is received by the receiver 34. The control circuit 36 is further configured to discontinue the third activation of the third electrically activated response (i.e. discontinue activation of the other device 62) in response to a loss of reception by the receiver 34 of the third occurrence of the continuous tone signal.

It will be further appreciated that once the cycle of activations and deactivations is completed, the cycle is preferably repeated for further consecutive generations of the continuous tone signal of the fixed frequency. Thus, the control circuit 36 is preferably configured to provide a second activation of the first one of the two different, electrically activated responses in response to reception by the receiver 34 of a third occurrence of the continuous tone signal from the wireless signal transmitter 26, consecutively after reception and loss of reception of the first and second occurrences of the continuous tone signal, to continue the second activation of the first one of the two different, electrically activated responses for as long as the third occurrence of the continuous tone signal is received by the receiver 34, and to discontinue the second activation of the first one of the two different, electrically activated responses in response to a loss of reception by the receiver 34 of the third occurrence of the continuous tone signal.

Similarly, the control circuit 36 is further configured to provide a second activation of the second one of the two different, electrically activated responses in response to reception by the receiver 34 of a fourth consecutive occurrence of the continuous tone signal from the wireless signal transmitter 26 consecutively after reception and loss of reception of the first, second and third occurrences of the continuous tone signal, to continue the second activation of only the second one of the two different, electrically activated responses for as long as the fourth occurrence of the continuous tone signal is received by the receiver 34, and to discontinue the second activation of the second one of the two different, electrically activated responses in response to a loss of reception of the fourth occurrence of the continuous tone signal by the receiver 34.

Figure 4:
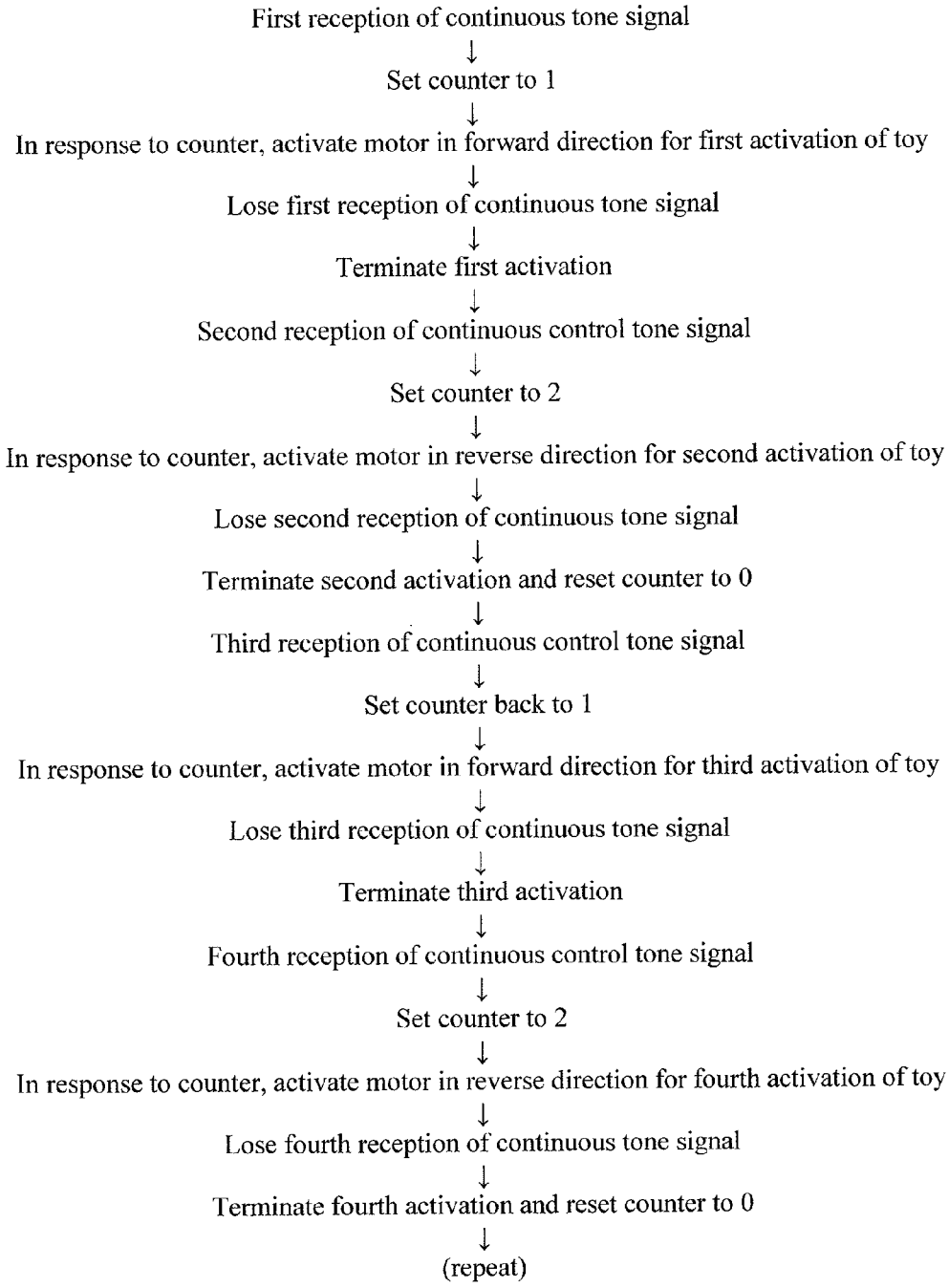
FIG. 4 depicts an example of a sequence of device activations of the toy vehicle.

The steps of this sequence and the repetition of this sequence of device activations for the toy vehicle 30 are depicted in FIG. 4 for the simplest preferred embodiment of the invention, the remotely controlled toy vehicle with just one reversible motor as the electrically activated device.

While a preferred embodiment of the invention has been disclosed, modifications to the preferred embodiments and other embodiments will occur to those of ordinary skill in the art. For example, it will be appreciated that the subcircuits 54, 56 and 64 may be activated in a different order. For example, subcircuit 54 could be first activated to provide forward movement of the toy vehicle 30. When that first activation is complete, the second occurrence of the continuous tone signal could trigger the activation of subcircuit 64, which might cause a sound effect to be played on a speaker 62. In response to the third occurrence of the continuous tone signal, the subcircuit 56 may be activated and the toy vehicle 30 backed up. That cycle of three activations would be repeated in that order for the fourth and subsequent occurrences of the continuous tone signal. Furthermore, the devices could be activated in different combinations as different sequential activations of the toy. So, for example, the second activation of the toy vehicle might be a reverse activation of the propulsion motor with a beeping sound and/or flashing light activation.

As already mentioned, although a vehicle is preferred as the remotely controlled toy, other types of vehicles than the automobile that is depicted and other types of toys including robots, dolls and other figures, that have also been remotely controlled, might employ the present invention.

While a microprocessor 42 is preferred for subcircuit activation and switching, activation of the various subcircuits connected with the electrically activated device(s) might be controlled by an arrangement of individual circuit components including but not limited to logic components, which may be connected together in an Application Specific Integrated Circuit (ASIC), designed to automatically switch on and off device activation subcircuits in a predetermined order in response to consecutive receptions of the continuous tone signal from the unit 20. It should further be appreciated that the "subcircuit" being electrically activated by the microprocessor 42 (or component array) might be nothing more than a lead or pair of leads from the microprocessor 42 (or component array operating as the control circuit) to the device being activated. It should also be appreciated that the coupling of the power supply to the activated device may be in the form of a discontinuous signal such as a duty cycle signal or another form of encoded (e.g. binary/digital) data signal from the controller. Moreover, the connection between the power supply 32 and the electrically activated device 52, 62, etc., might be directly through the microprocessor 42 rather than indirectly through an intermediate subcircuit like the motor control subcircuits. While the control circuit 30 steps through its program in response to reception and then loss of reception of the continuous tone signal, other predetermined events might be used to control operation of the microprocessor 42. For example, termination of the activations of electrically activated devices other than the propulsion motor, which would be initiated by receipt of the continuous tone signal, might be terminated by a timer or simply by the conclusion of the electrically activated response, for example, the completion of a predetermined sound effect generation or light/display activation or the completion of one or more predetermined cycles of a rotating or reciprocating element.

It will be appreciated that stated another way, the invention is a toy combination that includes a wireless remote control unit including a housing sufficiently small to be hand held with at least an electric power supply, a wireless signal transmitter configured to generate and transmit a continuous tone signal of a fixed frequency when powered by the power supply, and at least one manually operated switch having at least two states respectively operatively connecting and disconnecting the power supply with the wireless transmitter to selectively transmit the continuous tone signal of the fixed frequency. The combination further includes a remotely controlled toy with at least an on-board power supply, one or more electrically operated device each providing light, sound and/or movement of the toy which is apparent to an observer. The toy further includes a wireless signal receiver to receive the continuous tone signal of the fixed frequency and a control circuit operably connected with the wireless signal receiver, the on-board power supply and each of the one or more electrically operated devices and responsive to the tone signal. The controller is configured to control the at least one or more electrically operated devices to provide a predetermined sequence of separate and different activations apparent to an observer of the one or more devices in response to consecutive receptions and losses of reception of the continuous tone signal. Each different response of the sequence begins with a new reception of the continuous tone signal and ends with loss of the reception of the continuous tone signal. The next device activation of the sequence begins with the next reception of the continuous tone signal and ends with the loss of that reception. The sequence continues and is repeated for as long as reception and subsequent loss of reception of the continuous tone signal occurs. It will be appreciated that the controller, particularly if it is a microprocessor, can be configured to power down if the continuous tone signal is not received for a predetermined period of time to conserve to battery power and to power up again when a transmission of the continuous tone signal is newly received. The controller can be configured to begin the sequence at the beginning or pick up the sequence where it was last terminated.

U.S. Pat. No. 6,663,463 discloses circuitry for a remotely controlled toy vehicle, with a single, reversible electric motor, a pair of opposing motor drive subcircuits, a sound generation system as a third electrically actuated subcircuit, a wireless signal receiver and a preprogrammed microprocessor controlling all of the subcircuits. U.S. Pat. No. 6,663,463 is incorporated by reference herein as an example of such details.

It will be appreciated by those skilled in the art that still other changes could be made to the embodiments described above without departing from the broad inventive concept thereof. This invention is not limited to the particular embodiments disclosed.

I claim:

1. A toy combination comprising:

a wireless remote control unit including a housing sufficiently small to be hand held and at least:

an electric power supply;

a wireless signal transmitter configured to generate and transmit a continuous tone signal of a fixed frequency when powered by the power supply; and at least one manually operated switch having at least two states respectively operatively connecting and disconnecting the power supply with the wireless transmitter to selectively transmit the continuous tone signal of the fixed frequency; and a toy with at least:

an on-board power supply;

one or more electrically operated device each providing at least one of light, sound and movement of the toy apparent to an observer;

a wireless signal receiver to receive the continuous tone signal of the fixed frequency; and a control circuit responsive to the tone signal and operably connected with the wireless signal receiver, the on-board power supply and each of the one or more electrically operated devices and configured to control the at least one or more electrically operated devices to provide at least two different, electrically activated responses apparent to an observer, the control circuit being configured to first activate at least one of the one or more electrically operated devices in response to reception of a first occurrence of continuous tone signal from the wireless signal transmitter to provide a first one of at least two different, electrically activated responses, to continue the first activation for as long as the first occurrence of the continuous tone signal is received by the receiver, to discontinue the first activation in response to a loss of reception of the first occurrence of the continuous tone signal by the receiver, to activate at least one of the one or more electrically operated devices to provide a second electrically activated response different from the first electrically activated response in response to reception by the receiver of a second occurrence of the continuous tone signal from the remote control unit transmitter, and to thereafter discontinue the second activation in response to loss of reception of the second occurrence of the continuous tone signal.

2. The toy combination of claim 1 wherein the control circuit is configured to provide an other activation of the at least one of the one or more electrically operated devices in response to reception of a third occurrence of the continuous tone signal from the wireless signal transmitter to provide the first one of at least two different, electrically activated responses a second time, to continue the first one of at least two different, electrically activated responses the second time for as long as the third occurrence of the continuous tone signal is received by the receiver and to discontinue the other activation in response to a loss of reception of the third occurrence of the continuous tone signal by the receiver.

3. The toy combination of claim 1 wherein the control circuit is further configured to provide a second activation of the second one of the two different, electrically activated responses in response to reception by the receiver of a fourth consecutive occurrence of the continuous tone signal from the wireless signal transmitter consecutively after reception and loss of reception of the first, second and third occurrences of the continuous tone signal, to continue the second activation of the second one of the two different, electrically activated responses for as long as the fourth occurrence of the continuous tone signal is received by the receiver, and to discontinue the second activation of the second one of the two different, electrically activated responses in response to a loss of reception of the fourth occurrence of the continuous tone signal by the receiver.

4. The toy combination of claim 1 wherein at least one of the electrically operated devices of the toy is an electric motor providing at least one of the at least two different, electrically activated responses of the toy and wherein the control circuit is operatively connected with the electric motor so as to provide a first operation of the electric motor in response to reception by the receiver of the first occurrence of the continuous tone signal from the wireless signal transmitter as the first activation.

5. The toy combination of claim 4 wherein the control circuit is operatively connected with the electric motor so as to provide a second operation of the electric motor in a reverse direction to the first actuation as the second activation in response to reception by the receiver of the second occurrence of the continuous tone signal from the wireless signal transmitter consecutively after the reception and loss of reception of the first occurrence of the continuous tone signal.

6. The toy combination of claim 4 wherein the control circuit is operatively connected with an additional electrically responsive device generating at least one of light, sound and movement of part of the toy vehicle and configured so as to operate the other electrically responsive device as the second activation in response to reception by the receiver of the second occurrence of the continuous tone signal from the wireless signal transmitter consecutively after the reception and loss of reception of the first occurrence of the continuous tone signal.

7. The combination of claim 1 wherein the control circuit is further configured to provide a third activation of a third electrically activated response different from the first and second electrically activated responses in response to reception by the receiver of a third consecutive occurrence of the continuous tone signal from the wireless signal transmitter consecutively after reception and loss of reception of the first and second occurrences of the continuous tone signals, to continue the third activation of third electrically activated response without activation of the first or second electrically activated responses for as long as the third occurrence of the continuous tone signal is received by the receiver, and to discontinue the third activation of the third electrically activated response in response to a loss of reception of the third occurrence of the continuous tone signal by the receiver.

8. A toy combination comprising:

a wireless remote control unit including a housing sufficiently small to be hand held and at least:

an electric power supply;

a wireless signal transmitter configured to generate and transmit a continuous tone signal of a fixed frequency when powered by the power supply; and at least one manually operated switch having at least two states respectively operatively connecting and disconnecting the power supply with the wireless transmitter to selectively transmit the continuous tone signal of the fixed frequency; and a toy with at least:

an on-board power supply;

one or more electrically operated device each providing at least one of light, sound and movement of the toy apparent to an observer;

a wireless signal receiver to receive the continuous tone signal of the fixed frequency; and a control circuit operably connected with the wireless signal receiver, the on-board power supply and each of the one or more electrically operated devices and responsive to the tone signal to control the at least one or more electrically operated devices to provide a predetermined sequence of separate and different activations apparent to an observer of the one or more devices in response to consecutive receptions and losses of reception of the continuous tone signal, each different response beginning with a new reception of the continuous tone signal and ending with loss of the reception of the continuous tone signal, the next activation of the sequence beginning with the next reception of the continuous tone signal, the sequence being continued and repeated for as long as reception and subsequent loss of reception of the continuous tone signal occurs.

9. A method of operating the combination of claim 1 comprising the following steps in order:

manually operating the switch of the wireless remote control unit to broadcast through the wireless signal transmitter of the unit, a first occurrence of the continuous tone signal of the fixed frequency;

receiving the first occurrence of the continuous tone signal at the toy vehicle via the receiver;

providing a first activation of only the first one of the two different, electrically activated responses in response to reception by the receiver of the first occurrence of continuous tone signal of the fixed frequency from the wireless signal transmitter and continuing the first activation for as long as the first occurrence of the continuous tone signal of the fixed frequency is received by the receiver;

releasing the switch of the wireless remote control unit to discontinue the broadcast of the first occurrence of the continuous tone signal of the fixed frequency;

discontinuing the first activation in response to a loss of reception of the first occurrence of the continuous tone signal of the fixed frequency by the receiver;

manually operating the switch of the wireless remote control unit a second consecutive time to broadcast through the wireless signal transmitter of the unit, a second occurrence of the continuous tone signal of the fixed frequency;

providing a second activation of only the second one of the two different, electrically activated responses different from the first one in response to reception by the receiver of the second occurrence of the continuous tone signal of the fixed frequency from the remote control unit transmitter;

releasing the switch of the wireless remote control unit to discontinue the broadcast of the second occurrence of the continuous tone signal of the fixed frequency; and discontinuing the second activation in response to loss of reception of the second occurrence of the continuous tone signal of the fixed frequency.

* * * * *